US006299158B1

(12) United States Patent
Loeser et al.

(10) Patent No.: US 6,299,158 B1
(45) Date of Patent: Oct. 9, 2001

(54) STORAGE CASSETTE FOR AUTOMATIC BANK TELLER MACHINES WITH PRINTING CAPABILITY

(75) Inventors: Martin Loeser, Paderborn; Steffen Boerner, Borchen, both of (DE)

(73) Assignee: Siemens Nixdorf Informationssysteme Aktiengesellschaft, Paderborn (DE)

( * ) Notice: Subject to any disclaimer, the term of this patent is extended or adjusted under 35 U.S.C. 154(b) by 0 days.

(21) Appl. No.: 09/367,531

(22) PCT Filed: Jan. 16, 1998

(86) PCT No.: PCT/DE98/00146

§ 371 Date: Aug. 16, 1999

§ 102(e) Date: Aug. 16, 1999

(87) PCT Pub. No.: WO98/36383

PCT Pub. Date: Aug. 20, 1998

(30) Foreign Application Priority Data

Feb. 17, 1997 (DE) ..... 197 06 128

(51) Int. Cl.[7] ..... B65H 1/00
(52) U.S. Cl. ..... 271/162
(58) Field of Search ..... 271/1, 145, 162; 347/215, 218, 221, 222; 346/136; 226/152; 83/112, 156, 154

(56) References Cited

U.S. PATENT DOCUMENTS 5,648,837 * 7/1997 Tamai ..... 271/162 X
5,859,656 * 1/1999 Aragon et al. ..... 347/218
6,151,055 * 11/2000 Ackley et al. ..... 347/215

FOREIGN PATENT DOCUMENTS

| | | |
|---|---|---|
| 31 18 687 C2 | 5/1981 | (DE) . |
| 35 14 062 A1 | 4/1985 | (DE) . |
| 44 08 981 C1 | 3/1994 | (DE) . |
| 0 644 511 A2 | 8/1994 | (EP) . |
| 2 076 376 A | 5/1981 | (GB) . |
| 0 141 407 A | 12/1984 | (GB) . |
| 2 154 557 A | 9/1985 | (GB) . |

* cited by examiner

*Primary Examiner*—David H. Bollinger
(74) *Attorney, Agent, or Firm*—Schiff Hardin & Waite

(57) ABSTRACT

In a storage cassette which can be inserted into a receiving module, intended for receiving a bill cassette, of an automatic bank teller, and has on its front wall (12)—seen in the insertion direction—a withdrawal opening which can be closed by a flap and into which drawing-off elements (14) of a drawing-off device of the receiving module reach in order to withdraw sheet-shaped objects (62) from the cassette in the inserted state of the latter, there are arranged a printing device (28) for printing sheet-shaped printing carriers (24), a device (18, 20) for storing a supply (22) of printing carriers and a transport device (31) for transporting a printing carrier (24) through the printing device (28) up to a withdrawal position in which the printing carrier (62) is located parallel to the front wall (12) in the region of the withdrawal opening.

19 Claims, 2 Drawing Sheets

STORAGE CASSETTE FOR AUTOMATIC BANK TELLER MACHINES WITH PRINTING CAPABILITY

The present invention relates to a storage cassette which can be inserted into a receiving module, intended for receiving a bill cassette, of an automatic bank teller.

BACKGROUND OF THE INVENTION

Such a storage cassette is known, for example, from DE-44 08 981 C1. Furthermore, there is known from DE-35 14 062 A1 an automatic bank teller in which a plurality of storage units for bills are arranged one above another, each have a drawing-off and separating device, and are connected to a common vertical collective transporter. Provided instead of the lowermost storage unit is a dedicated slide-in unit which contains a printing device for printing sheet-shaped printing carriers such as check forms, vouchers and the like, a device for storing a supply of printing carriers, and a transport device, which transports the printing carriers from the storage device through the printing device to a dispensing opening of the slide-in unit, with the result that the printed printing carriers can be transferred to the collective transporter of the automatic bank teller. As a result, it is possible for the automatic bank teller not only to dispense bills but also to print check forms and provide vouchers. However, in the case of the solution described there, the slide-in unit containing the printing device can only be installed in the automatic bank teller at the factory, instead of a bill storage unit. In exchange, the operator of the automatic bank teller does not have the option of sliding into the automatic bank teller a bill storage unit or a printer slide-in unit.

SUMMARY OF THE INVENTION

It is an object of the invention to enable the operator of an automatic bank teller optionally himself to replace a bill storage cassette by a device by means of which it is possible to print sheet-shaped objects, such as check forms, receipts, credit notes, vouchers or the like, which are to be dispensed via the automatic bank teller.

This object is achieved in the case of a storage cassette of the type mentioned at the beginning by virtue of the fact that there are arranged in the storage cassette a printing device for printing sheet-shaped printing carriers, a device for storing a supply of printing carriers and a transport device for transporting a printing carrier through the printing device up to a withdrawal position in which the printing carrier is located parallel to the front wall in the region of the withdrawal opening.

By contrast with the solution known from DE-35 14 062 A1, the solution according to the invention has the advantage that the storage cassette containing the printing device is externally completely identical to a bill cassette, and can thus be pushed into the same receiving module as it. The storage cassette according to the invention can therefore be exchanged straightaway, should the need exist, for a bill cassette by the operator of the automatic bank teller. The printed printing carrier is provided in the storage cassette according to the invention in the same way as a bill in a known bill cassette, and can therefore be drawn off by the drawing-off device arranged in the receiving module, and transferred to the transport track of the automatic bank teller. If the automatic bank teller contains a plurality of receiving modules, it is also possible, if necessary, for a plurality of storage cassettes according to the invention to be inserted, or replaced again by bill cassettes. The result of this is a high degree of flexibility in the use of the automatic bank teller.

The device for storing a supply of printing carriers preferably has a holder for rotatably mounting a printing-carrier supply roll, and a separating device for severing from the printing-carrier supply roll individual sheets which are to be dispensed. This solution offers a substantial simplification by comparison with storing individual sheets, since relatively complicated devices are required for drawing off and transporting individual sheets.

In the solution according to the invention, the transport device has at least one transport roller which is arranged downstream of the printing device or in the latter and is intended for engaging with the printing carrier, the separating device being arranged downstream of the transport roller. In this way, the printing carrier can be drawn from the supply roll by the printing device and be transported further via the separating device before it is then severed from the endless printing-carrier track by means of the separating device.

In order to keep the printing carrier in the withdrawal position, the invention provides a holding frame for receiving a printing carrier which is to be dispensed, the holding frame preferably having two mutually parallel support elements which form between them a receiving gap for the printing carrier, and of which the support element facing the front wall of the storage cassette has an opening for the engagement of the drawing-off elements. This ensures that the printing carrier to be dispensed is reliably held until it can be gripped by the drawing-off elements.

In order not to have to deflect the printing carrier too severely in the cassette, and to keep the printing-carrier transport as simple as possible, it is expedient if the holding frame can be adjusted, for example pivoted, between a receiving position, in which the receiving gap is aligned with the printing carrier emerging from the separating device, and the withdrawal position In order to ensure that the printing carrier, which is, as the case may be, slightly curved through being drawn off from a supply roll, can be reliably introduced into the holding frame, preferably on both sides of the inlet opening of the receiving gap the support elements have outwardly diverging instruction surfaces.

A controllable clamping device is expediently arranged on the holding frame for the purpose of clamping a printing carrier introduced into the holding frame, so that after being inserted into the receiving gap the printing carrier does not slip when being severed from the printing-carrier track, nor during adjustment of the holding frame. This clamping device can have at least one clamping element which reaches into the receiving gap of the holding frame, is pretensioned in the direction of one of the support elements, and can be deflected against its pretension in the receiving position of the holding frame. This can be performed, for example, by a stationary element which strikes against the clamping element in the receiving position of the holding frame, and deflects said element.

The separating device expediently comprises a blade which can be adjusted transverse to the transport plane of the printing carrier. A thermal printing head is preferably used for the printing device.

In an embodiment, the present invention provides a storage cassette for insertion into a receiving module of an automatic teller machine. The receiving module is normally intended to receive a bill cassette. However, the storage cassette of the present invention will be received into the receiving module. The receiving module includes at least one drawing-off element for withdrawing sheet-shaped objects from the storage cassette. The storage cassette comprises a housing which comprises a front wall comprising a withdrawal opening. The withdrawal opening accommodates the drawing-off element of the receiving module. The housing is connected to a printing device for printing sheet-shaped objects, a storage device for storing a supply of sheet-shaped objects and a transport device for transporting the sheet-shaped objects from the storage device through the printing device to a withdrawal position wherein the sheet-shaped object is disposed parallel to the front wall and in registry with the withdrawal opening.

In an embodiment, the housing is connected to a holder for rotatably mounting a sheet supply roll to the housing and a separating device for severing individual sheet-shaped objects from the roll after the printing thereof. The separating device is disposed between the printing device and the withdrawal position.

In an embodiment, the transport device comprises at least one transport roller disposed downstream of the printing device.

In an embodiment, the transport device comprises at least one transport roller connected to the printing device.

In an embodiment, the housing is connected to a holding frame for receiving the printed sheet-shaped object from the transport device. The holding frame is pivotally mounted to the housing and is pivotable between a receiving position and the withdrawal position.

In an embodiment, the holding frame comprises two parallel front and rear support elements which define a receiving gap for receiving the sheet-shaped object. The front support element faces the front wall of the storage cassette and further comprises an opening for receiving the at least one drawing-off element. The opening of the front support element being in registry with the withdrawal opening of the front wall of the housing when the holding frame has been pivoted to the withdrawal position.

In an embodiment, the holding frame can pivot between a receiving position in which the receiving gap is aligned with the printing device and the withdrawal position where the holding frame carries the sheet-shaped object to the withdrawal position.

In an embodiment, the front and rear support elements each comprise upstream ends which are flared outwardly away from each other to provide outwardly diverging guide surfaces.

In an embodiment, the holding frame is connected to a controllable clamping device for clamping a sheet-shaped object into the holding frame.

In an embodiment, the clamping device comprises at least one clamping element that is biased towards one of the support elements. That support element also includes a slot for receiving a stationary flat nose. The stationary flat nose is connected to the housing and extends into the slot of the support element when the holding frame is pivoted into the receiving position. This action pushes the clamp away from the support element thereby enabling a sheet-shaped object to be received in the receiving gap of the holding frame.

In an embodiment, the separating device comprises a blade which extends transversely across the section of the storage roll that has been printed.

In an embodiment, the printing device comprises a thermal printing head.

Other objects and advantages of the present invention will become apparent from reading the following detailed description and appended claims, and upon reference to the accompanying drawings.

BRIEF DESCRIPTION OF THE DRAWINGS

Further features and advantages of the invention proceed from the following description which, in conjunction with the attached drawings, explains the invention with the aid of an exemplary embodiment. In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
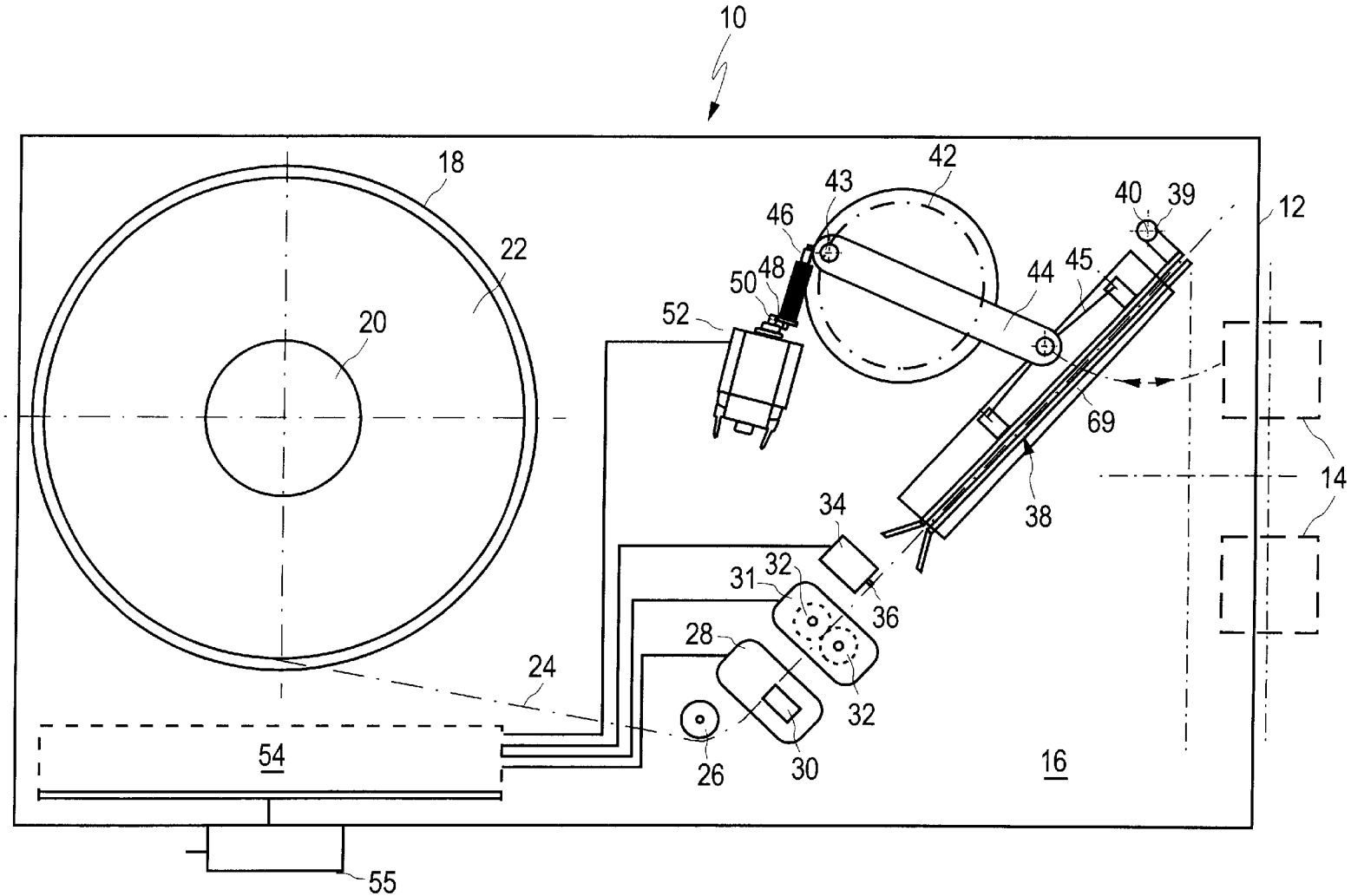
FIG. 1 is a diagrammatic plan view of a storage cassette according to the invention.

The storage cassette represented diagrammatically in FIG. 1 comprises a cuboid housing which is usually closed by a cover which is removed in the representation of FIG. 1 so that it is possible to look into the cassette. Such a cassette is usually employed for storing bills, and can be inserted into a receiving module arranged in an automatic teller. Located on the narrow side on the right in FIG. 1, which—referred to the insertion direction of the cassette—forms the front wall 12 of the cassette, is a flap (not represented) which, upon insertion of the cassette into the receiving module, uncovers a withdrawal opening through which it is possible for there to reach in the inserted position of the cassette drawing-off rollers 14 which belong to a drawing-off and singling device of the receiving module. They are represented diagrammatically in FIG. 1. The cassette described so far is known in principle, for example from DE 44 08 981 C1.

Located in the left-hand half of the housing 10 in FIG. 1 is a rotary table 18 which is rotatably mounted on the cassette base 16 and has a mandrel 20 onto which there is plugged a supply roll 22 of a paper strip forming a printing carrier or paper strip 24. Depending on the intended use, the paper strip 24 can be entirely unprinted or, for example, bear a prescribed pattern, as is usual for check forms. The width of the paper strip, that is to say the axial height of the supply roll 22, is limited by the height of the cassette housing 10.

Located to the right of the rotary table 18 is a deflecting roller 26, a printing device 28 with a thermal printing head 30, and a transport device 31 with two transport rollers 32. The paper web 24 can be drawn off from the supply roll 22 by means of the two mutually cooperating transport rollers 32, and runs around the deflecting roller 26 and past the printing head 30. It is also possible to use a printing device with a press roller which takes over the transport of the paper web 24. The two transport rollers 32 can then be omitted.

Located downstream of the transport device 31 is a cutting device 34 with a blade 36 which can be adjusted transverse to the plane of the paper web 24 displaced by the transport device 31, in order to sever said web. There is no need for a further explanation of the configuration of this cutting device 34. Appropriate cutting devices are commercially available.

Located downstream of the cutting device is a holding frame 38 which serves to receive the printing carrier printed by means of the printing head 30, and will be explained in more detail further below with the aid of FIG. 2. By means of a shaft 39, the holding frame 38 can be swivelled about a swivelling axis 40 directed perpendicular to the base 16 of the cassette 10 between its receiving position, reproduced in FIG. 1 with continuous lines, and a withdrawal position in which the holding frame 38 is parallel to the front wall, and which is indicated by a dashed and dotted line. The adjustment is performed via an eccentric drive. The latter comprises a gearwheel 42 mounted parallel to the cassette base 16 and having an eccentric pin 43 which is connected via a link 44 to a holder 45, constructed as a leaf spring, on the holding frame 38.

The gearwheel 42 meshes with a screw 46 which, for its part, is connected in terms of drive via a gearwheel 48 coaxial with it to the output pinion 50 of an electric motor 52.

The printing device 28, the transport device 31, the cutting device 34 and the positioning motor 52 for adjusting the holding frame 38 are controlled by an electronic control device 54 which is arranged in the cassette housing 10 next to the supply roll 22, and which is fed control signals and the operating voltage via a plug connector 55 fitted on the outside of the cassette housing 10.

Figure 2:
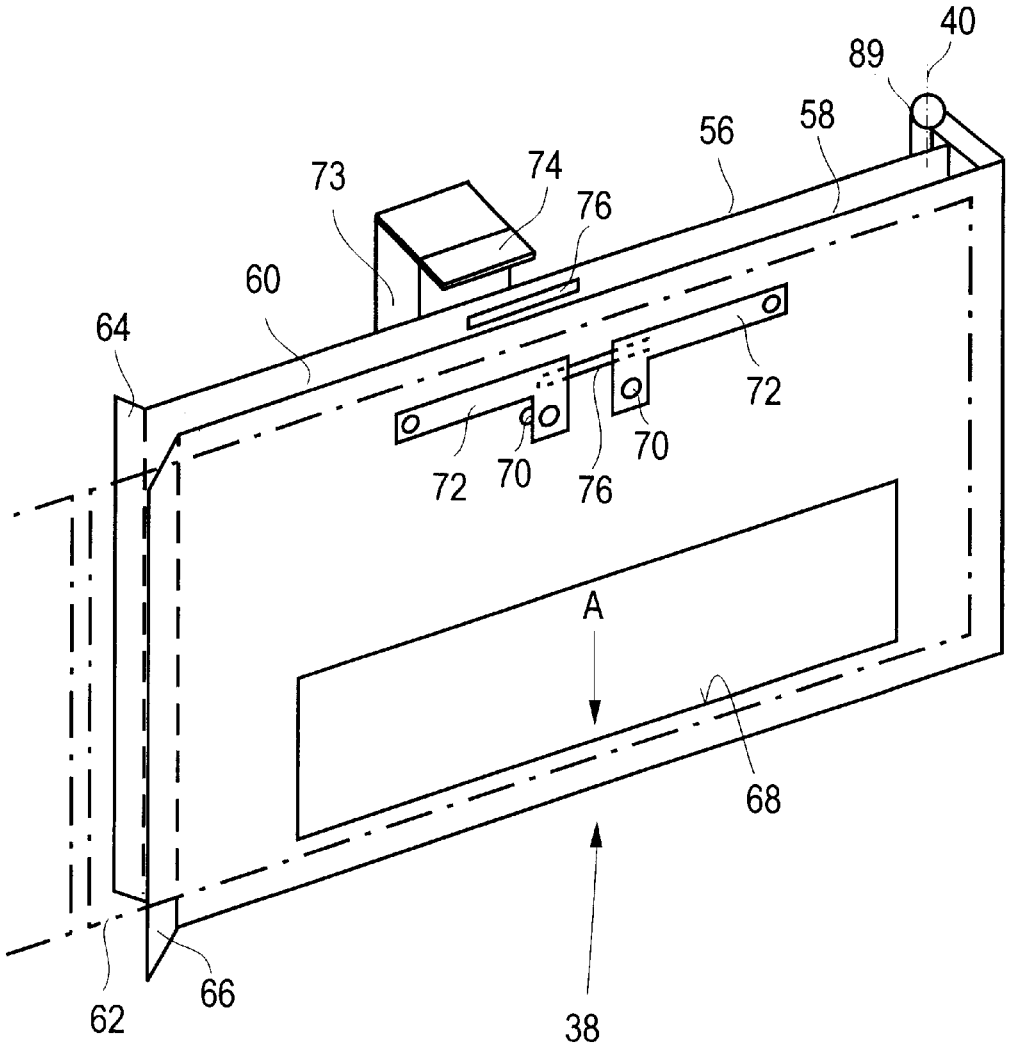
FIG. 2 is a perspective representation of the holding frame of the storage cassette shown in FIG 1.

The holding frame represented in FIG. 2 comprises a first plate 56 and, parallel thereto, a second plate 58, which form between them a receiving gap 60 for a printed printing carrier 62 (indicated by dashes). Both plates 56 and 58 are connected rigidly to the shaft 40. At their end averted from the shaft 39, that is to say on the entry side of the receiving gap 60, the plates 56 and 58 are lengthened by outwardly diverging guide surfaces 64, 66 which form an insertion funnel for reliably inserting the printing carriers 62 into the receiving gap 60 of the holding frame 38. Below the holding frame 38 located in the receiving position is a support plate 69 (see FIG. 1) on which the printing carrier 62 is supported.

The front plate 58, facing the viewer in FIG. 2, which also faces the front wall 12 of the cassette housing 10 in the withdrawal position of the holding frame 38, has a withdrawal opening 68 through which the drawing-off rollers 14 can reach into the receiving gap 60 of the holding frame 38. In the withdrawal position of the holding frame, the drawing-off rollers 14 are situated on the printing carrier 62 located in the receiving gap 60, and press said carrier against the rear plate 56. If the drawing-off rollers 14 are actuated, they can draw the printing carrier 62 off downward out of the receiving gap 60 in the direction of the arrow A.

The printing carrier 62 is held by means of a clamping device so that it cannot fall out downward from the receiving gap 60 after insertion into the receiving gap 60, severance from the paper web 24 and swivelling of the holding frame 38 out of the receiving position. Said clamping device comprises two clamping pins 70, which pass through the front plate 58 of the holding frame 38 and are each fastened on a leaf spring 72 which tightens the clamping pin 70 against the rear plate 56. A printing carrier 62 located in the receiving gap 60 is thereby clamped against the rear plate 56. The clamping force is large enough to retain the printing carrier 62 in the receiving gap 60. The clamping force can, however, be overcome by the drawing-off force of the drawing-off rollers 14.

In order to be able to insert the printing carrier 62 into the receiving gap 60 in the receiving position of the holding frame 38, the clamping pins 70 must be moved out of the receiving gap 60. This is performed by a stationary flat nose 74, that is to say one which is connected permanently to the cassette base 16 via a holder 73, and said nose is arranged such that in the receiving position, represented in FIG. 1, of the holding frame 38 it passes through mutually aligned slots 76 in the two plates 56 and 58 and raises the leaf springs 72, which tighten the clamping pins 70 in the direction of the rear plate 56, outward from the plate 58. As a result, the clamping pins 70 are drawn out of the receiving gap 60. When the holding frame 38 is swivelled parallel to the front wall 12 out of the receiving position represented in FIG. 1 into its withdrawal position, the nose 74 remains behind, with the result that the leaf springs 72 and thus the clamping pins 70 can pivot back into their clamping position.

Depending on the type of paper web used and on the control of the printing head 30, the printing device arranged in the storage cassette according to the invention can be employed to produce any desired blank forms. Examples of this are the printing of checks, receipts, credit notes, payment slips or withdrawal slips, bank statements and the like. The essential advantage of the solution according to the invention consists in that this storage cassette can be inserted into the same receiving module as a bill cassette, and can therefore be inserted as required by the operator of the automatic teller without there being any need for structural alterations in the automatic teller. The result of this is a high degree of flexibility in operating the automatic teller.

It is also possible to insert a plurality of data carriers 62 one after another into the holding frame 38, so that a stack is formed therein.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A storage cassette for insertion into a receiving module of an automatic teller machine, the receiving module intended to receive a bill cassette, the receiving module including at lease one drawing-off element for withdrawing sheet-shaped objects from the storage cassette, the storage cassette comprising:

a housing comprising a front wall comprising a withdrawal opening, the withdrawal opening accommodating the at least one drawing-off element of the receiving module, and the housing being connected to a printing device for printing sheet-shaped objects, a storage device for storing a supply of sheet-shaped objects and a transport device for transporting the sheet-shaped objects from the storage device through the printing device to a withdrawal position wherein the sheet-shaped objects are disposed parallel to the front wall and in registry with the withdrawal opening, whereby the housing is connected to a holder for rotatably mounting a sheet supply roll in the housing, the housing is also connected to a separate device for severing individual sheet-shaped objects from the roll after the printing thereof, and the separating device is disposed between the printing device and the withdrawal position.

2. The storage cassette of claim 1 wherein the transport device comprises at least one transport roller disposed downstream of the printing device.

3. The storage cassette of claim 1 further comprising a holding frame for receiving at least one sheet-shaped object, the holding frame being pivotally mounted to the housing and being pivotable to the withdrawal position.

4. The storage cassette of claim 3, wherein the holding frame can be swivelled to a withdrawal position and comprises two parallel front end and rear support elements which define a receiving gap for receiving the sheet-shaped object, the front support element facing the front wall of the storage cassette and further comprises an opening for receiving the at least one drawing-off element said opening being in registry with the withdrawal opening of the front wall of the housing when the holding frame has been swivelled to the withdrawal position.

5. The storage cassette of claim 4 wherein the holding frame can pivot between a receiving position, in which the receiving gap is aligned with the printing device, and the withdrawal position wherein the holding frame carries a sheet-shaped object to the withdrawal position.

6. The storage cassette of claim 4 wherein the front and rear support elements each comprise upstream ends that receive leading edges of the sheet-shaped objects, the upstream ends being flared outwardly away from each other to provide outwardly diverging guide surfaces.

7. The storage cassette of claim 4 wherein the holding frame is connected to a controllable clamping device for clamping a sheet-shaped object into the holding frame.

8. The storage cassette of claim 7 wherein the clamping device comprises at least one clamping element which extends into the receiving gap of the holding frame, the at least one clamping element being biased in the direction of the rear support element, the rear support element comprising a slot therein, the housing being connected to a stationary flat nose that extends into the slot when the holding frame is in the receiving position to push the at least one clamping element away from the rear support element to thereby enable a sheet-shaped object to be receiving the in the receiving gap.

9. The storage cassette of claim 7 wherein the clamping device comprises at least one clamping element which extends into the receiving gap of the holding frame, the at least one clamping element being biased in the direction of the front support element, the front support element comprising a slot therein, the housing being connected to a stationary flat nose that extends into the slot when the holding frame is in the receiving position to push the at least one clamping element away from the front support element to thereby enable a sheet-shaped object to be receiving the in the receiving gap.

10. The storage cassette of claim 1 wherein the separating device comprises a blade which can extends transversely across a plane defined by a portion of the storage roll as said portion passes through the printer.

11. The storage cassette of claim 1 wherein the printing device comprises a thermal printing head.

12. A storage cassette for insertion into a receiving module of an automatic teller machine, the receiving module intended to receive a bill cassette, the receiving module including at least one drawing-off element for withdrawing sheet-shaped objects from the storage cassette, the storage cassette comprising:

a housing comprising a front wall comprising a withdrawal opening, the withdrawal opening accommodating the at least one drawing-off element of the receiving module, the housing being connected to a printing device for printing sheet-shaped objects, a holder for rotatably mounting a sheet supply roll in the housing, a separating device for severing individual sheet-shaped objects from the roll after the printing thereof, a transport device for transporting the sheet-shaped objects from the storage device through the printing device to a holding frame, the holding frame for receiving at least one sheet-shaped object from the transport device, the holding frame being pivotally mounted to the housing and being pivotable to the withdrawal position, the holding frame comprising two parallel front and rear support elements which define a receiving gap for receiving the sheet-shaped object from the transport device, the front support element facing the front wall of the storage cassette, the front support element further comprising an opening for receiving the at least one drawing-off element, said opening being in registry with the withdrawal opening of the front wall of the housing when the holding frame has been pivoted to the withdrawal position the separating device being disposed between the printing device and the holding frame.

13. The storage cassette of claim 12 wherein the transport device comprises at least one transport roller disposed downstream of the printing device.

14. The storage cassette of claim 12 wherein the front and rear support elements each comprise upstream ends that receive leading edges of the sheet-shaped objects, the upstream ends being flared outwardly away from each other to provide outwardly diverging guide surfaces.

15. The storage cassette of claim 12 wherein the holding frame is connected to a controllable clamping device for clamping a sheet-shaped object into the holding frame.

16. The storage cassette of claim 15 wherein the clamping device comprises at least one clamping element which extends into the receiving gap of the holding frame, the at least one clamping element being biased in the direction of the rear support element, the rear support element comprising a slot therein, the housing being connected to a stationary flat nose that extends into the slot when the holding frame is in the receiving position to push the at least one clamping element away from the rear support element to thereby enable a sheet-shaped object to be receiving the in the receiving gap.

17. The storage cassette of claim 15 wherein the clamping device comprises at least one clamping element which extends into the receiving gap of the holding frame, the at least one clamping element being biased in the direction of the front support element, the front support element comprising a slot therein, the housing being connected to a stationary flat nose that extends into the slot when the holding frame is in the receiving position to push the at least one clamping element away from the front support element to thereby enable a sheet-shaped object to be receiving the in the receiving gap.

18. The storage cassette of claim 12 wherein the separating device comprises a blade which can extends transversely across a plane defined by a portion of the storage roll as said portion passes through the printer.

19. The storage cassette of claim 12 wherein the printing device comprises a thermal printing head.

* * * * *